US008418715B2

(12) United States Patent
Spitzer

(10) Patent No.: US 8,418,715 B2
(45) Date of Patent: Apr. 16, 2013

(54) CONTROL SYSTEM

(75) Inventor: Artur Spitzer, Tostedt (DE)

(73) Assignee: Roediger Vacuum GmbH, Hanau (DE)

( * ) Notice: Subject to any disclaimer, the term of this patent is extended or adjusted under 35 U.S.C. 154(b) by 95 days.

(21) Appl. No.: 13/038,449

(22) Filed: Mar. 2, 2011

(65) Prior Publication Data

US 2011/0214758 A1 Sep. 8, 2011

(30) Foreign Application Priority Data

Mar. 2, 2010 (DE) ..... 10 2010 000 609

(51) Int. Cl.
*F16K 31/126* (2006.01)

(52) U.S. Cl.
USPC ..... 137/488; 137/205; 137/395; 137/396; 137/907; 251/331; 251/335.2; 4/431; 4/434; 4/323

(58) Field of Classification Search ..... 137/488, 137/205, 395, 396, 907; 251/331, 335.2; 4/431, 434, 323
See application file for complete search history.

(56) References Cited

U.S. PATENT DOCUMENTS

| | | | | | |
|---|---|---|---|---|---|
| 3,766,933 | A * | 10/1973 | Nicholson, Jr. | ..... | 137/116.3 |
| 3,977,423 | A * | 8/1976 | Clayton | ..... | 137/12 |
| 3,998,736 | A * | 12/1976 | Greenleaf, Jr. | ..... | 210/104 |
| 4,166,476 | A * | 9/1979 | Yamanaka et al. | ..... | 137/103 |
| 4,373,838 | A * | 2/1983 | Foreman et al. | ..... | 406/14 |
| 4,390,036 | A * | 6/1983 | Athanassiu et al. | ..... | 137/116.5 |
| 4,466,455 | A * | 8/1984 | Athanassiu et al. | ..... | 137/116.5 |
| 5,069,243 | A * | 12/1991 | Foreman | ..... | 137/205 |
| 5,114,280 | A * | 5/1992 | Ushitora et al. | ..... | 406/18 |
| 5,555,910 | A * | 9/1996 | Powell et al. | ..... | 137/488 |
| 5,570,715 | A * | 11/1996 | Featheringill et al. | ..... | 137/205 |
| 5,588,458 | A * | 12/1996 | Ushitora et al. | ..... | 137/205 |
| 5,615,701 | A * | 4/1997 | Yamabe et al. | ..... | 137/205 |
| 5,634,494 | A * | 6/1997 | Martens | ..... | 137/624.11 |
| 5,657,784 | A | 8/1997 | Martens | | |
| 5,992,449 | A * | 11/1999 | Sprague | ..... | 137/488 |
| 6,119,283 | A | 9/2000 | Galler | | |
| 6,311,718 | B1 * | 11/2001 | Hafner et al. | ..... | 137/205 |
| 6,321,772 | B1 * | 11/2001 | Uehara et al. | ..... | 137/112 |
| 6,360,768 | B1 * | 3/2002 | Galler | ..... | 137/205 |
| 6,467,494 | B1 * | 10/2002 | Kolb et al. | ..... | 137/12 |
| 7,013,909 | B2 * | 3/2006 | Shimizu et al. | ..... | 137/205 |
| 7,845,028 | B2 * | 12/2010 | Lindroos | ..... | 4/431 |

FOREIGN PATENT DOCUMENTS

| | | |
|---|---|---|
| DE | 3727661 | 3/1989 |
| DE | 10026843 | 7/2001 |
| DE | 102006028732 | 1/2008 |
| EP | 0649946 | 4/1995 |
| EP | 1091053 | 4/2001 |

* cited by examiner

*Primary Examiner* — John K Fristoe, Jr.
*Assistant Examiner* — Minh Le
(74) *Attorney, Agent, or Firm* — Ladas & Parry LLP

(57) ABSTRACT

A control system for a purge valve that can be actuated by low pressure, which can be used for a low pressure or vacuum waste water system, encompassing a first valve and a second valve. The purge valve can be actuated as a function of its position, and the accumulated waste water can be drawn off via the sewage system.

13 Claims, 7 Drawing Sheets

CONTROL SYSTEM

BACKGROUND OF THE INVENTION

The invention relates to a control system for a purge valve that can be actuated by low pressure, provided for a low-pressure drainage system, enclosing a housing with external wall, a dynamic pressure, caused by waste water accumulated in this, of the first valve that can be switched over to a second position, a first chamber restricted by the first valve that can pressure-adjusted by the first membrane. In doing so, the first membrane is functionally connected with a second valve, via which low pressure or atmospheric pressure is reached as a function of its position at the purge valve, a first connection, through which the first chamber can be connected with a low pressure source, which is blocked in case of missing or too low dynamic pressure by the first valve located in its first position and is released with sufficient dynamic pressure in its second position of the first valve. Further, it relates to an adjustable second connection linked with the first chamber leading to the atmospheric pressure, whereby in case of the first chamber subjected to sufficient low pressure, the first membrane together with the second valve can be changed-over by a first position connecting the purge valve with atmospheric pressure into a second position connecting the purge valve with low pressure, and whereby the first valve in its second position releasing the first connection between the source of low pressure and the first chamber blocks the second connection leading to the first chamber and subjected to atmospheric pressure.

In order to keep waters pure, it is necessary that waste water reaches the clarification plants. Frequently this is not possible because of relatively high costs of conventional sewer systems or due to difficult local conditions like deficient natural downward gradient, small settlement density, unfavourable underground or crossing of a water protection zone. In addition, for such problems, it is possible to carry out disposal from clarification plant if low pressure drainage or "vacuum sewerage system" is used.

As essential components, appropriate vacuum sewerage system includes domestic shafts with a de-energized control system and stop valves or purge valves, a following line system with systematically arranged high and low points as well as a vacuum station with sewage collection tanks, sewage pumps, vacuum pumps, measuring and control technique. In order to convey waste water, this system flows from buildings via the usual free downward gradient building connection lines to a sump of a shaft laid within the plot, in which only pneumatically controlled stop valves and the associated control system are accommodated. Connected with the sump is an air-entrapped pitot tube, whereby the enclosed air is hydrostatically compressed by the liquid accumulated in the sump, so that a dynamic pressure is produced.

Thanks to the mechanism existing in the control system, the stop valve is opened in the presence of a fixed dynamic pressure and the waste water is exhausted into the vacuum line. Depending on time, the valve closes after a few seconds because of spring action and vacuum. The waste water is collected at the low points in the line system and is pushed by the added air gradually via the following high points toward the vacuum station. From the collection tank of the vacuum station the waste water is conveyed with the help of usual sewage pumps via a pressure pipe and a freefall chute to the clarification plant. In the collection tank and in the line system, a low pressure generator like a vacuum pump maintains a low pressure. The control system assigned to the stop valve should thereby facilitate an automatic matching to the waste water portions being which exhausted and to the operating conditions (e.g. the strength of the existing low pressure) in the drainage system.

A control system as per DE-C-43 36 020 is configured extremely compact and structurally simple and offers a high operating reliability. Regardless of the level of the available low pressure, a time control takes place essentially, which means that after the cessation of dynamic pressure, if the liquid is drawn off, then the control system closes the low pressure supply to the stop valve after a defined time interval and the stop valve is ventilated with ambient air, so that the stop valve is closed. The time interval remaining after purging before closing the purge valve serves for allowing transport air from the environment into the low pressure system. For system function, it would be desirable, if the volume ratio of let-in air and the absorbed liquid were higher, and weaker would be the prevailing low pressure. The above-mentioned control equipment is distinguished in particular by the fact that it keeps the after-opening time nearly constant for air and smaller the volume of exhausted waste water, the weaker would be the existing low pressure. A further advantage of this control equipment lies in effecting a suddenly changing condition of control to that extent that the connection to the second valve controlling the stop valve can be changed over all of a sudden.

Further, U.S. Pat. No. 4,373,838 discloses a control system as offered under the nomenclature "AIRVAC". In order to facilitate a time control via a pressure-adjustable chamber, hoses with small diameter are necessary, which can be easily added, so that efficiency is not always guaranteed, especially when the supplied ambient air is dirty or damp. Even a clear On/Off-control of a valve, guiding the low pressure to the stop valve, is not specified. This means that it can come to a flutter of the stop valve with weak low pressure. In addition, the quantity of waste water and/or waste water air-mixture per opening cycle of the stop valve is not clearly defined. This can lead to malfunctions, in particular with large waste water accumulation. Further, it is disadvantageous that the suction time is dependent on low pressure existing in a system that is unfavourable for the entire system, since the opening times are dependent on the prevailing low pressure for their part. So the opening time in case of small low pressure is shorter than with strong low pressure. Thus, the danger exists with weak low pressure and large quantities of water collected in the sumps that the supply network is flooded and thus a normal function is no longer specified; for, with a flooded system the low pressure strength continues to decrease.

Further, it is unfavourable that the second valve releasing the low pressure to the stop valve can be opened with negligible low pressure, which is not always sufficient for rapid suction. Thereby, the danger arises that waste water is raised into the frost range of the line and can freeze out there.

DE-A-37 27 661 discloses a pneumatic control device for a stop valve at a low pressure sewer. In order to ensure a precision setting and reliable functioning of the control device, at least one control valve as well as a minimum low-pressure relief valve is necessary, besides a first valve actuated by a dynamic pressure and an elaborately designed time-control mechanism.

A control system of the type initially specified can be inferred from EP-A-1 091 053, which is simply set up and guarantees that liquid cannot penetrate into the chamber subjected to low pressure.

Further control systems for a purge valve that can be actuated by low pressure can be inferred from EP-A-0 649 946, DE-A-100 26 843, DE-U-296 16 003 or DE-B-10 2006 028 732.

SUMMARY OF THE INVENTION

The present invention underlies the task of further configuring a control system, as specified in the beginning, in such a way that with simplified design as against the known control system a high reliability is ensured. At the same time, it must be guaranteed that the liquid cannot penetrate and/or accumulate in the control system that would impair the efficiency. According to a further aspect, it is possible to modify the actuation of the control valve and thus the purge valve in a simple manner, so that an actuation can take place with the desired dynamic pressure. Also if necessary, manual changeover of the control system should be facilitated for actuating the purge valve.

For the solving the task, it is essentially foreseen that the first valve involves a triggering membrane, through which the first connection can be closed in the first position of the first valve, and a second membrane connected by a spacer element with the triggering membrane, through which the second connection can be closed in the second position of the first valve, whereby a gap between the triggering membrane and the second membrane is subjected to dynamic pressure.

In general, the object of the invention is a control system for a purge valve that can be actuated by low pressure, intended for a low-pressure drainage system, comprehensively a first valve as well as a second valve, depending on its position the purge valve can be actuated, through which the accumulated waste water can be exhausted into the sewage system. For a rearrangement of the first valve functionally connected with the second valve, a dynamic pressure developed by accumulated waste water, which impinges on the gap between a triggering membrane and a dynamic pressure membrane, which form a unit and the first valve.

Deviating from the earlier designs, two designs exert on the membranes forming a unit, i.e. the triggering membrane and the second membrane, which is also designated as dynamic pressure membrane, the first valve through which depending on the function of dynamic pressure prevailing between the membranes the first chamber is subjected to low pressure or atmospheric pressure in such a manner that the second valve designated as control valve facilitates or closes a connection between low pressure connection and purge valve.

An inventive design feature foresees that the triggering membrane closes or opens a second chamber depending on its position, which is located in the flow path between the source of low pressure and the first chamber in the first connection and which is connected with the source of low pressure in the first position of the first valve. For adjusting the switching operation as a function of the prevailing dynamic pressure, the invention provides that the second chamber can be adjusted via an element that can be actuated from outside via the housing in its pressure-loaded surface that is active with regard to the triggering membrane.

In particular, it is foreseen that the second chamber has a circular floor area on the membrane side, which is restricted on the periphery by a sealing element such as O-ring, and that an adjusting element, accessible from the housing exterior, used for adjusting the sealing element acts on the sealing element. If, for example, the area of the second chamber is made smaller, then a loosening of the triggering membrane by the seal is possible and thus adjusting the first valve is possible with smaller dynamic pressure than with larger floor space of the second chamber.

Preferably the adjusting element is flexibly arranged in a duct-shaped opening such as bore, which can be externally sealed. In order to make a definite adjustment possible, pin elements of defined length can be brought into the bore. However, there is also the possibility of using an element that can be threaded into the bore, so as to change the surface subjected to low pressure via the second chamber using a type of spindle.

The triggering membrane has the geometry of a shaft-like seal having a U-shaped, circulating peripheral section, and also an inner section designed as flat packing, which can be mounted on the seal limiting the second chamber.

The triggering membrane can be characterized in such a way that the position sealing the second chamber has a U or double-U-shaped geometry with preferably a circulating L-shaped edge, through which the triggering membrane can be fixed in a first dividing wall of the housing. A quasi crucible-shaped geometry with its outwardly arched wall is specified.

Starting from the ground wall, designated as flat packing, for the triggering membrane, the spacer element connected with the second membrane leads to a common adjustment. For secured attachment, it is foreseen that from the centre range of the inside of the ground wall emanates an inner overhang with a through-bore, which is interspersed by peg-shaped pin element and is connected with a first mounting plate, from which the second membrane goes out.

In particular, it is foreseen that the second membrane proceeds from a plate-shaped first mounting plate, which is linked to the triggering membrane via the spacer and/or pin element.

The first membrane limiting the first chamber should likewise emanate from a mounting plate designated as second mounting plate, which is forced into a second dividing wall via a spring element running toward the first chamber; the dividing wall runs away from the first valve and is interspersed by the piston of the second valve.

The first membrane and the second dividing wall interspersed by the piston limits a third chamber, which is attached to a connection leading to atmosphere. The piston emanating from the second mounting plate housing the first membrane produces a connection between the third chamber and a fourth chamber as a function of the position of the second valve, which can be blocked via the second valve opposite a low pressure connection or can be connected with the latter. From the fourth chamber emanates a connection for the purge valve.

In case of the closed second valve low pressure prevails in the second chamber that is closed by the triggering membrane in the first position of the first valve via the low pressure connection. The first chamber and the third chamber are subjected to atmospheric pressure. The atmospheric pressure prevails on the side of the second membrane facing the triggering membrane; the second membrane limits a fifth chamber, which is externally sealed by a housing wall. A connection between the atmosphere connection and the fifth chamber takes place via the channels running in the housing wall, whereby the atmosphere intersperses a filter connecting the fifth chamber with the channels.

The fifth chamber is also connected with the first chamber via a channel running in the housing wall. Further, this is connected with an area running between the exterior of the triggering membrane and the first dividing wall through a channel interspersing the first dividing wall. If a sufficient dynamic pressure is present in the gap between the triggering membrane and the second membrane, then the unit comprising triggering membrane and second membrane is adjusted to the seal limiting the second chamber in such a manner that the vacuum can continue into the first chamber. At the same time, thanks to the second membrane, the connection channel between the fifth chamber and the first chamber is sealed. Due to the pressure drop in the first chamber with simultaneously further atmospheric pressure build-up in the first membrane on the side facing the first chamber as well as a valve disk of the second valve that can be adjusted in the fourth chamber, on which atmospheric pressure acts likewise, which has a smaller surface than the first membrane with pressurised surface of the second mounting plate, the spring action exerted by the spring on the first membrane and/or its mounting plate affects can be overcome, so that the second valve is adjusted, i.e. opened. At the same time, the connection between the third and fourth chamber via the valve pistons is sealed off, so that low pressure can now reach the purge valve via the opened second valve and this is thus reversed; because the valve disk seals the low pressure-charged first connection between the low-pressure source and the first chamber with simultaneous application of pressure on the first chamber with atmospheric pressure.

After the desired reduction of dynamic pressure, the unit starts the triggering membrane second membrane forming the first valve, in its basic position, and consequently seals the second chamber opposite the first chamber, so that a further low pressure build-up of the same does not take place. The low pressure is even reduced now via the channel that can no more sealed by the second membrane, the former connects the fifth chamber with the first chamber connected with atmospheric pressure. Thereby, the spring force can act on the first membrane and/or its mounting plate in such a manner that the second valve is closed. At the same time, atmospheric pressure flows through a channel that is no more sealed by the valve piston into the second dividing wall for connecting the purge valve outgoing from the fourth chamber, so that the latter is changed over and blocked.

In a further embodiment of the invention, it is foreseen that the valve piston in axial direction has a projection jutting out of the valve disk, by means of which an axial adjustment of the valve piston is facilitated by means of a sealed housing opening with closed second valve with the consequence that a manual actuation of the control system and thus a changeover of the purge valve are enabled.

Further, the said control system differs from other known configurations in such a way that the connections for the low pressure, the purge valve and the atmosphere, connected via pipe unions with the housing, are vertically aligned in operating position of the control system and the connected chambers are so aligned to the pipe unions that any accumulated liquid or condensate can flow off due to gravity. This relates to at least the third and the fourth chamber.

BRIEF DESCRIPTION OF THE DRAWINGS

Further details, advantages and features of the invention are obtained not only from the claims, the features to be inferred, but also from the following description of the preferred embodiments as deduced from the drawings.

Shown are.

DESCRIPTION OF THE PREFERRED EMBODIMENTS

FIGS. 1 to 6 show longitudinal sections of a control system 10 according to the invention, through which the purge valve, specified for a low-pressure drainage system, can be actuated.

Figure 1:
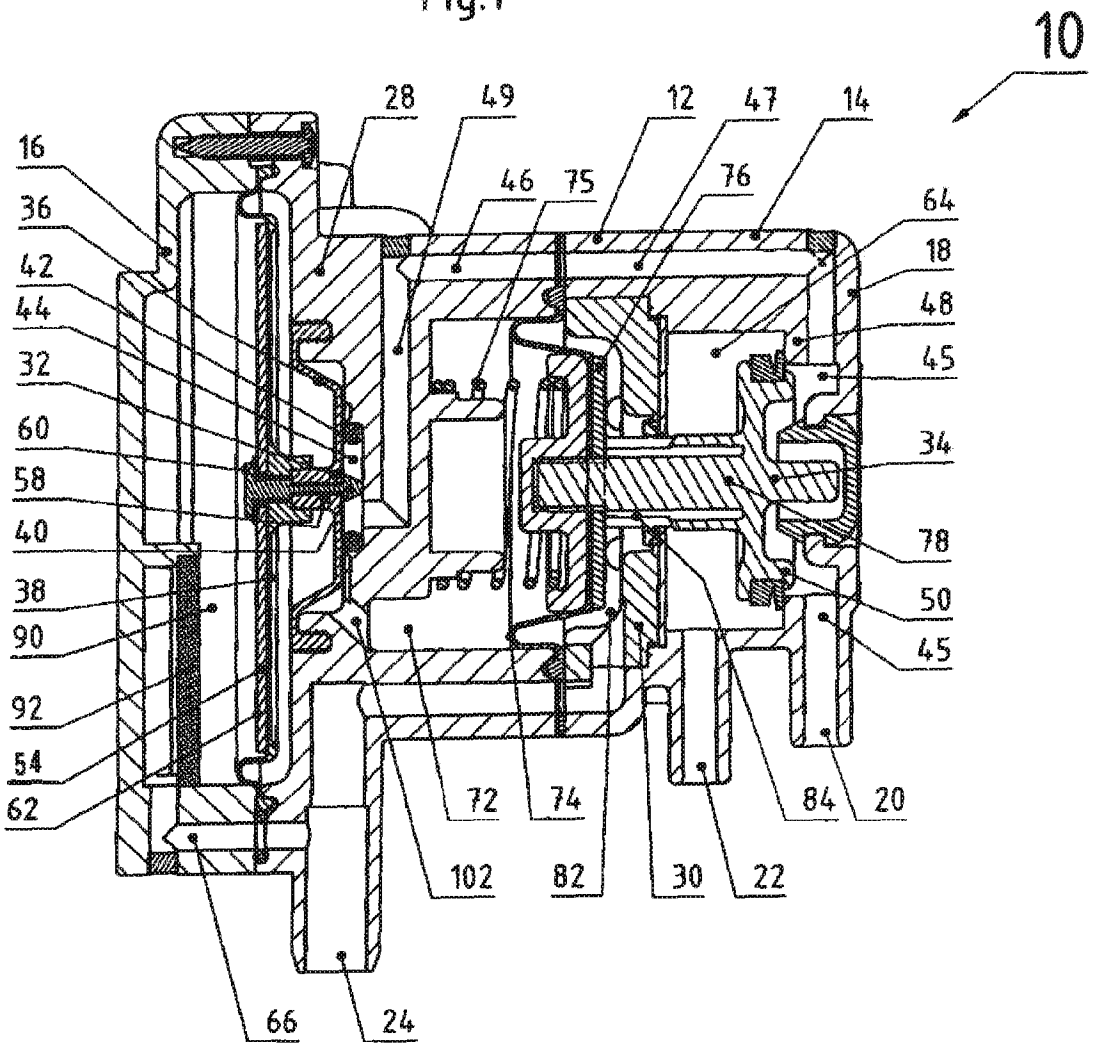
FIG. 1: a first sectional view of a control system in the absence of dynamic pressure.
Figure 2:
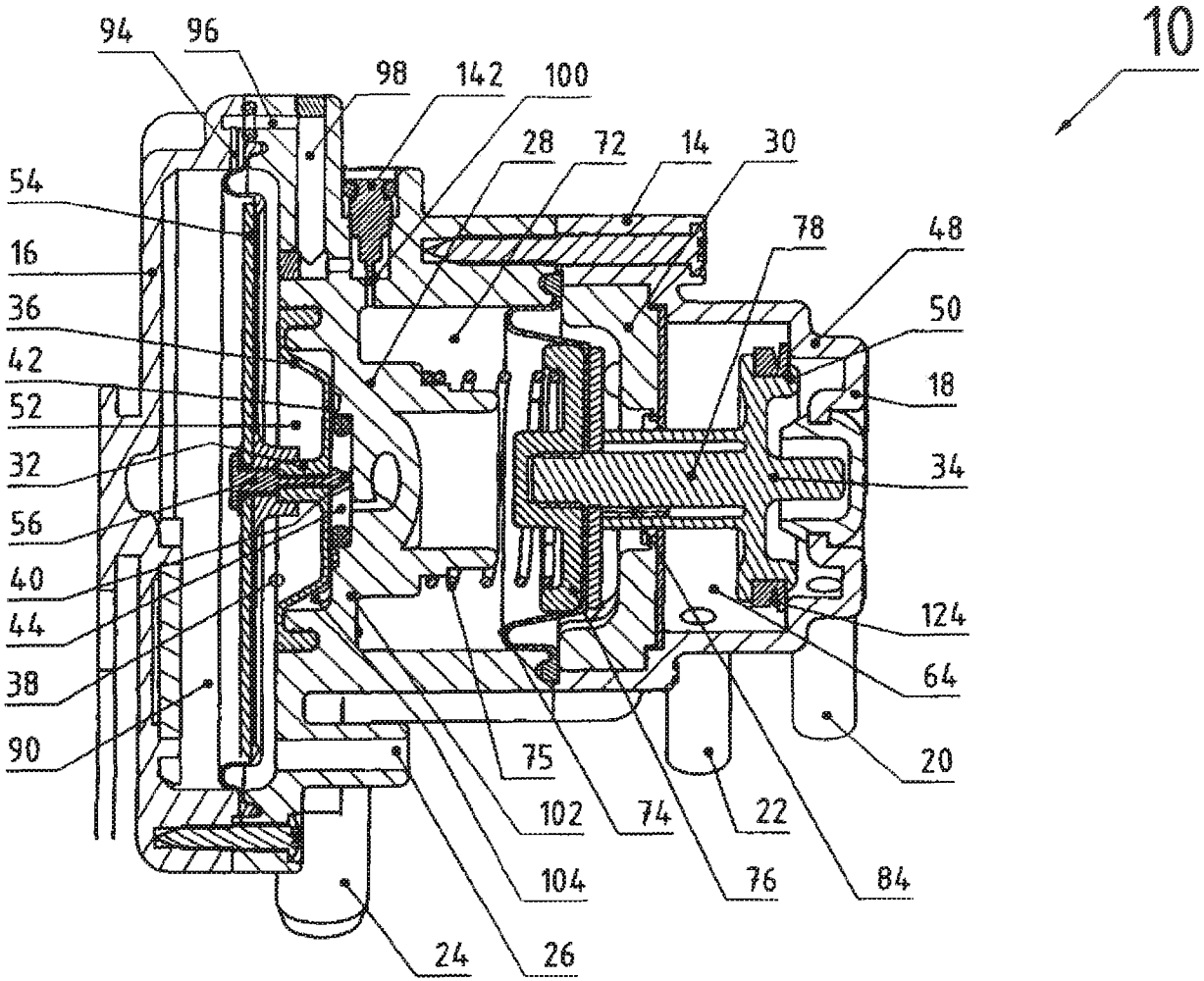
FIG. 2: control system as per FIG. 1 in a further sectional view.
Figure 3:
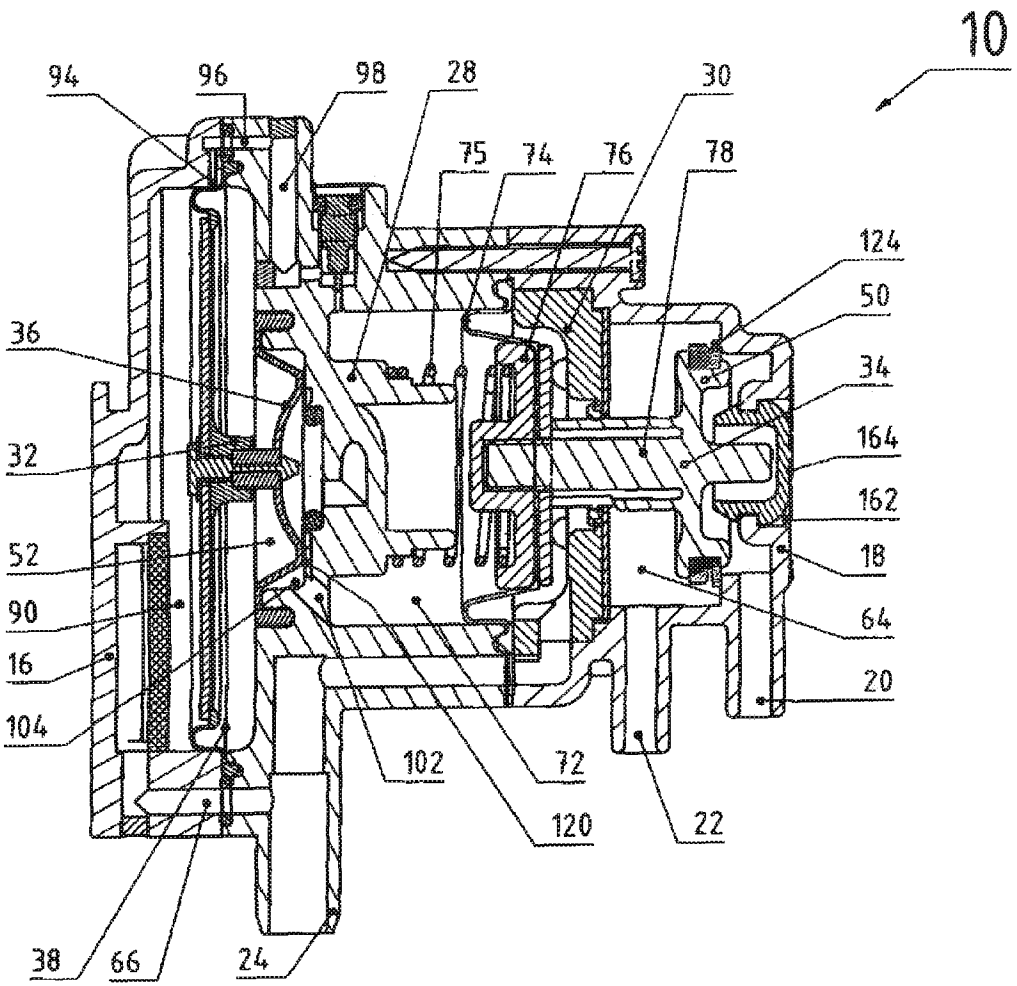
FIG. 3: control system according to FIGS. 1 and 2 in the presence of dynamic pressure before actuating a control valve integrated in the control system.
Figure 4:
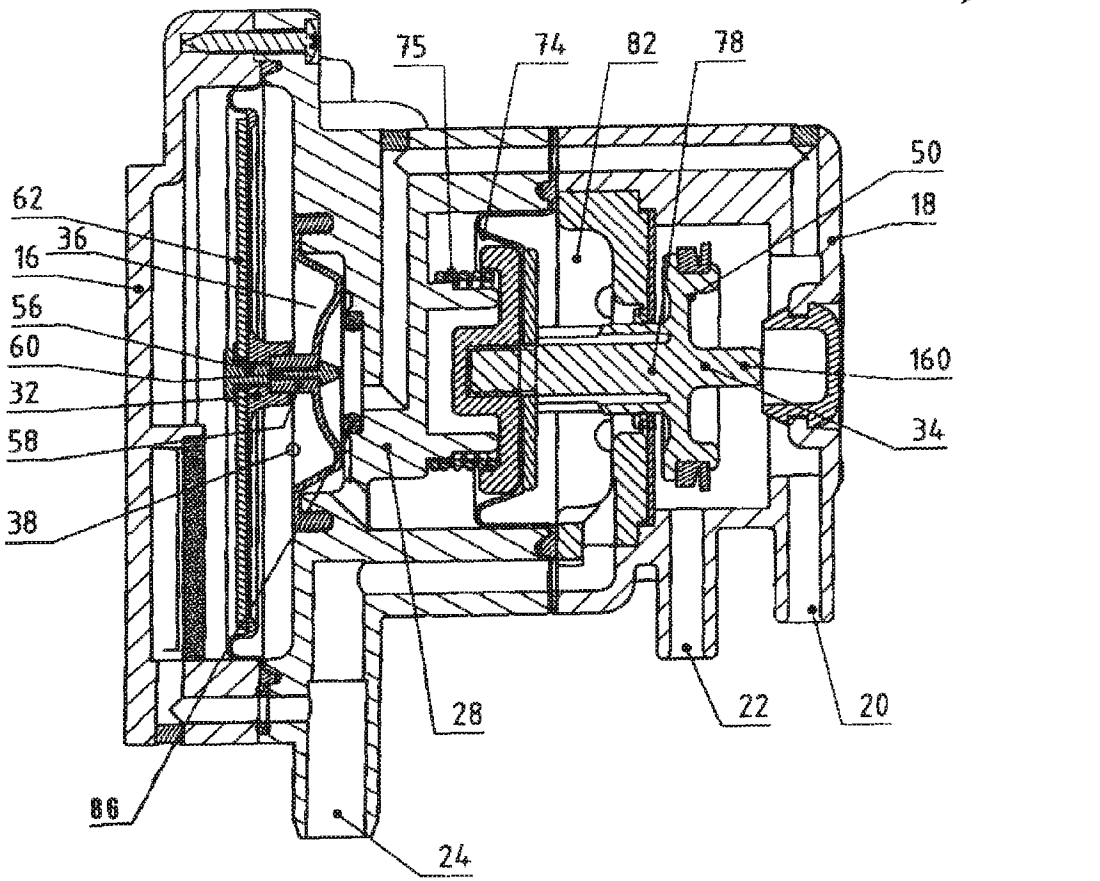
FIG. 4: control system in accordance with FIGS. 1 to 3 with opened control valve.
Figure 5:
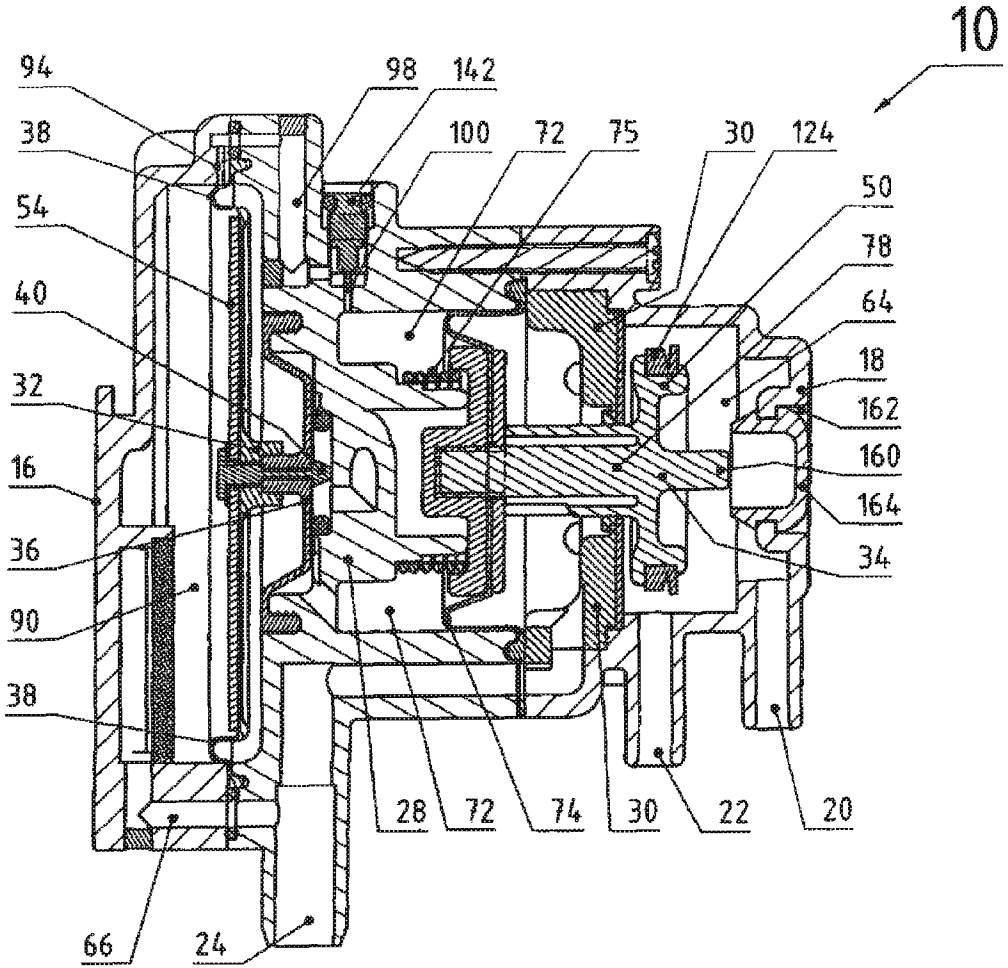
FIG. 5: control system as per FIG. 4 with opened control valve, but reduced dynamic pressure.

The de-energized but pneumatically working control system 10, also known as universal control, has a stepped cylindrical housing 12, with an extent wall 14 as well as front walls 16, 18. FIG. 1 shows the control system 10 in its installation position, so that the tubing or pipe unions 20, 22, 24 are vertically aligned below. The pipe union 20, which runs within the range of the front wall 18 shown on the right in the illustration, is connected with the low pressure source of the low-pressure water system. Low pressure is designated below as vacuum.

The neighbouring connecting piece 22 leads to the purge valve, and the connecting piece 24 running in the area of the left front wall 16 produces a connection to the atmospheric pressure.

Further a connection 26 is present, which is connected to a collector, in which dynamic pressure is built up as a function of the accumulated and waste water which can be drawn off. The level of the dynamic pressure determines the actuation of the purge valve of the type as described below.

The housing 12 has a first dividing wall 28, which is obvious from the drawing of the left front wall 16, and a second dividing wall 30, which runs between the first dividing wall 28 and the right front wall 18.

Essential components of the control system 10 are a trip valve 32 designated as the first valve as well as a second valve 34, which is a control valve, through which a connection between the vacuum connection 20 and the connection 22 for the stop valve can be produced or sealed, and indeed as a function of the dynamic pressure. The trip valve 32 comprises a triggering membrane 36 and a second membrane 38, which are connected with one another for achieving a movement in the same direction via a connecting or a spacer element 40.

With the closed trip valve 32, a second chamber 44 is sealed via a ground section 42 of the triggering membrane 36, which is connected by a channel 46 with the vacuum connection connecting piece 20 running in the first dividing wall 28 of the extent wall 14 as well as the right front wall 18. The channel 46, which consists of sections 45, 47, 49, is thereby sealed with the closed control valve 34 via a valve disk 50, lying close to the valve seat 48, of the control valve 34 opposite a chamber 64 designated as the fourth chamber, from which the pipe sockets 20, 22 proceed to the vacuum and/or the purge valve. With more sealed second chamber 44, the ground section 42 lies close to a circulating seal 86 like O-ring, which limits the second chamber 44 peripherally.

The gap 52 between the triggering membrane 36 and the second membrane 38 is connected with the connection 26, which is subjected to dynamic pressure.

The second membrane 38 also known as dynamic pressure membrane, which originates from a plate-like first mounting plate 54, is connected via a connecting element 56 with the triggering membrane 36, which thus forms the supporting element 40 and/or part of this. For a secured connection, the membrane 36 has an inner cylindrical projection 58 with a thorough-bore, which is sealed tight by the pin-shaped connecting element 56 and secured via a one-sided truncated conical extension 60. The opposite end of pin-shaped connecting element 56 lies at external side 62 of the plate-type first mounting plate 54 of the second membrane 38 and is configured as quasi screw-head shape.

The membrane 36 has a form of a rotary shaft seal, which has a circulating U-shaped peripheral section, which is fixed in the first dividing wall 28. The ground section 42 sealing the second chamber 44 tightly acts like a flat packing.

On the side of the first dividing wall 28 facing the trip valve 32, chamber 72 designated as the first chamber is present, which is sealed on the one side by the dividing wall 28 and on the other, by a membrane 74 designated as the first membrane, which originates from a second mounting plate 76. A spring element 75 supporting at the first dividing wall 28 or emanating from this section acts on the second mounting plate 76, so that the second mounting plate 76 is forced in the direction of the second dividing wall 30.

Further, from the second mounting plate 76 originates the piston 78 of the control valve 34, which would put through the second dividing wall 30.

With closed trip valve 32 (FIGS. 1-2) atmospheric pressure reaches channel 66 in the chamber 90 designated as the fifth chamber via the connection 24; the chamber is restricted on the one hand, by the exterior of the second membrane 38 and/or the first mounting plate 54 and on the other, by the front wall 16 or by a wall adjoining the same. Between the channel 66 and the fifth chamber 90 a filter 92 is foreseen. From the fifth chamber 90 emanates a further channel 94 running diametrical to the pipe socket 24 and parallel to the front wall 16, which with reference to the curved boundary region of the second membrane 38 runs in such a manner that the channel 94 is blocked with closed trip valve 32 that can be flown through with the opened trip valve 32. Through the channel sections 96, 98 running via the housing wall 12 and a nozzle gap 100, which serves that time-controlled change-over of the control valve 34, the first chamber 72 is subjected to atmospheric pressure in case of opened channel 94, if the trip valve 32 is closed. The first chamber 72 is connected via a channel 102 with an area between the exterior of membrane 36 and the first dividing wall 28. This area, which forms an annular space with closed trip valve 32, is designated with reference symbol 104.

Further, the atmospheric pressure prevails over the pipe union 24 in a third chamber 82, which runs between the second mounting plate 76, at which the spring 75 is pushed away, and the second dividing wall 30. With closed control valve 34, the atmospheric pressure can flow into the fourth chamber 64 along the longitudinal slots 84 running in longitudinal direction of the piston 78; the pipe socket 22 starts from the chamber 64, which is connected with the purge valve. Consequently, the atmospheric pressure is maintained at the purge valve resulting in the fact that this is closed.

If a dynamic pressure 52 is built-up in the gap 52 between the triggering membrane 36 and the second membrane 38 so that the low pressure prevailing in the second chamber 44, which tightens the triggering membrane 36 and thus its ground section 42 lies close to seal 86, and the retaining strength produced by the low pressure is thus overcome, then the second membrane or dynamic pressure membrane 38/triggering membrane 36 is moved towards left as shown in the drawing (see FIG. 3) with the consequence that on the one hand, the channel 94 designated as ventilation channel is sealed by the second membrane 38, and on the other, the low pressure present in the second chamber 44 also prevails in the first chamber 72, via over a groove running on the membrane-side in the first dividing wall 28 and/or a gap 120 via the channel 102, so that the atmospheric pressure is drawn off. Owing to the atmospheric pressure prevailing in the third chamber 82 which is restricted on the one hand, by the first membrane 74 as well as the second mounting plate 76 and the second dividing wall 30, on the other, the force exerted by the spring 75 on the second mounting plate 76 can be overcome with the consequence that the control valve 34 opens, since its piston 78 is connected with the second mounting plate 76. Thus, the valve disk 50 with its seal 124 can be separated from the valve seat 48, so that the channel 46 subjected to low pressure leading to the fourth chamber 64 is no more sealed, so that the purge valve is subjected to low pressure via the pipe union 22. By adjusting the piston 78, the longitudinal slot 84 present in longitudinal direction in the peripheral wall are simultaneously closed, so that the fourth chamber 64 can no more be subjected to atmospheric pressure.

The change-over of the control valve 34 takes place regardless of the fact that both the valve disk 50 and the first membrane 74 and their mounting plate 76 (2nd mounting plate) are subjected to atmospheric pressure, since the surface of the control membrane 74 with effective surface of the mounting plate 76 is larger than the surface of the valve disk 50. The dimensioning of the surfaces and the spring action is such that low pressure in the first chamber 72 should approximately amount to absolute 0.21 to 0.24 bar, in order to facilitate a change-over of the control valve 34.

Immediately after the opened purge valve the dynamic pressure is reduced in gap 52 designated as dynamic pressure chamber, the trip valve 32 moves to the right in the illustration due to the pre-stressing of the triggering membrane 36, so that the second chamber 44 is sealed by the adjacent floor area 42 of the triggering membrane 36 at the seal 86 peripherally surrounding the second chamber, so that a connection to the atmosphere does not exist any more; because the gap 120 in the first dividing wall 28, leading to the first chamber 72, runs outside of the second chamber 44. At the same time, the channel 94 is opened by adjusting the second membrane 38, i.e. its peripheral swelling, so that atmosphere can flow via the channels 96, 98 and the nozzle gap 100 into the first chamber 72.

Thanks to the operational sequence as described before, it becomes obvious that the triggering membrane 36 and the second membrane 38 perform the function of a valve. The cross-section of nozzle gap 100 can be altered by turning a screw 142, whereby the time duration, with which the first chamber 72 is subjected to atmospheric pressure, can be adjusted. Since now, same pressure ratios prevail on both sides of the first membrane 74 and/or its mounting plate 76, the spring 75 can so adjust the second mounting plate 76 toward the second dividing wall 30 and thus the piston 78 of the control valve 34 that the latter (34) is closed, i.e. seal 124 of the valve disk 50 lies close to the valve seat 48. In this moment, the channel 46, attached to the low pressure, opposite the fourth chamber 64 is blocked. At the same time, atmospheric pressure can flow into the fourth chamber 64 via the longitudinal slot 84 present in the peripheral wall of the piston 78 with the consequence that the purge valve is accordingly impinged via the pipe union 22, so that the valve closes.

Figure 6:
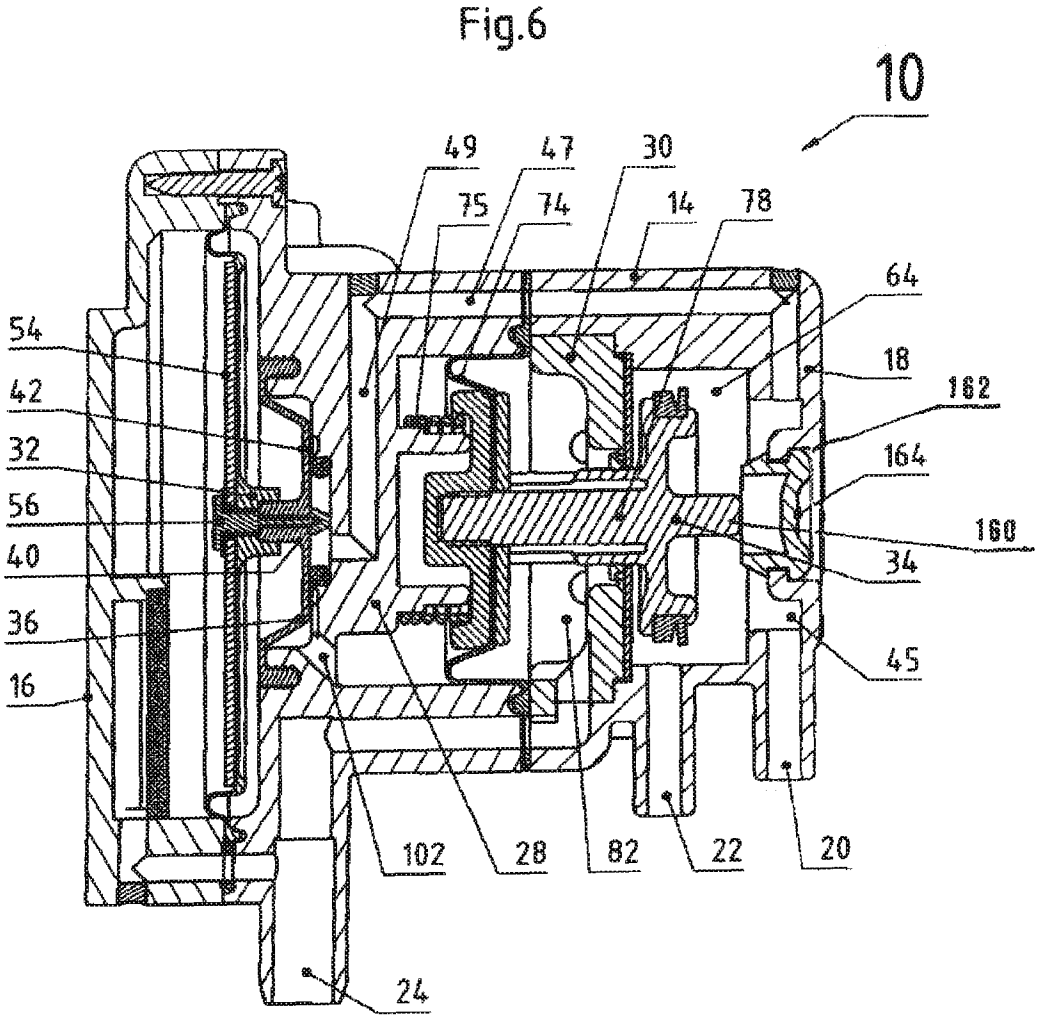
FIG. 6: control system in accordance with FIG. 1, but with manually operated opened control valve.

As evident from FIG. 6, it is possible to open the control valve 34 without which the necessary dynamic pressure prevails in the gap 52 between the triggering membrane 36 and the second membrane 38. For this, it is foreseen that from the piston 78 a projection 160 juts out via the plane stretched by the valve disk 50, which is aligned to an opening 162 in the front wall 18, whereby the opening 162 is sealed by a flexible element such as rubber element 164. Thus, an axial force can act on the extension (projection 160) via element 164 on the valve piston 78 with the consequence that the valve piston 78 is adjusted inside the housing 12, so as to open the control valve 34. In case the axial force is dispensed with, which acts on the piston 78, then the force of the coil spring 75 becomes apparent with the consequence that via the second mounting plate 76 the piston 78 is moved backward into its basic position for locking the control valve 34.

Figure 7:
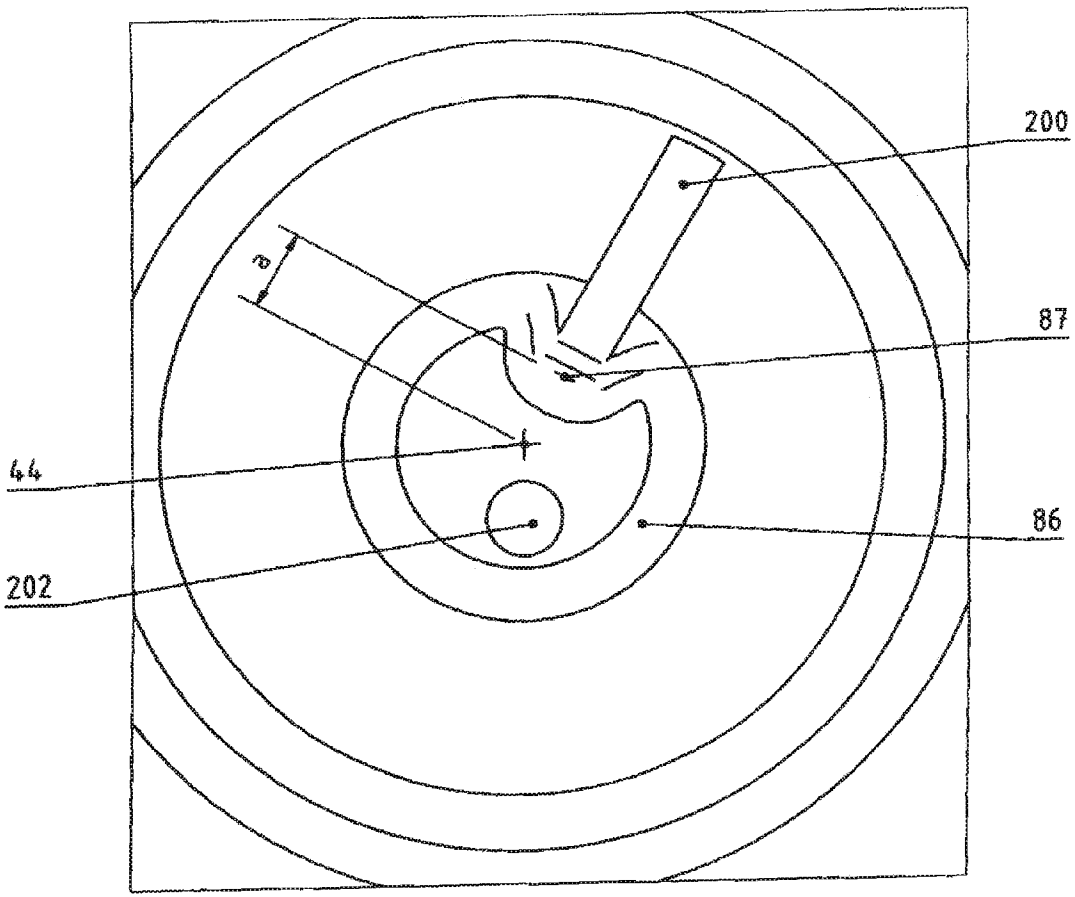
FIG. 7: enlarged view of a control system facility for adjusting the level of the dynamic pressure, in order to actuate the control system.

An inventive characteristic of the control system 10 is the design possibility of adjusting the effective surface of the second chamber 44 acting on the triggering membrane 36 so that the control system 10 can be triggered with the desired dynamic pressures. For this, it is possible to shift the seal 86, like O-ring, peripherally restricting the second chamber 44. According to FIG. 7, this can happen via the adjusting elements such as pins 200, used in the housing, by which the seal 86 is more or less pressed inward (area 87). The adjusting elements 200 can have the desired length and are used in a channel of the housing 12 (not shown), which is sealed tight from outside.

Instead of using different pin lengths, a pin with a thread pin can be screwed into the channel, so that an adjustment can be facilitated for a spindle. From the graphic illustration of FIG. 7, it can be further seen that the channel section 49 opens into second chamber 44 via an opening 202, through which the chamber 44 is subjected to low pressure.

What is claimed is:

1. Control system (10) for a purge valve (12) actuatable by low pressure, intended for a low-pressure or vacuum waste water system, comprising:

a housing with an external wall, a first valve arranged in the housing and switchable from a first position to a second position by dynamic pressure caused by accumulated waste water, a first chamber (72) bordered by a first membrane (74), and pressure adjustable via the first valve, and functionally connected with a second valve (34), via which, depending on position, low pressure or atmospheric pressure, to reaches the purge valve, a first connection (46), via which the first chamber is connectable with a low pressure source, which in the absence of or at too low dynamic pressure is cut off from the first valve in the first position, and which, at sufficient dynamic pressure, is released by the first valve in the second position, a second connection (90, 94, 96, 98) leading to atmospheric pressure and connected with the first chamber, the second connection preferably being adjustable in cross-section, with the first chamber being subjected to sufficient low pressure, the first membrane together with the second valve being switchable from a first position connecting the purge valve to atmospheric pressure to a second position connecting the purge valve to a low pressure, and with the first valve in the second position, the first connection being released between the source of the low pressure and the first chamber, cutting off the second connection that leads to the first chamber and is capable of being subjected to atmospheric pressure, wherein the first valve (32) comprises a release membrane (36), via which the first connection (46) is lockable when the first valve is in the first position, and a second membrane (38), connected by a spacer element (40) with the release membrane, and cutting off the second connection (90, 94, 96, 98) when the first valve is in the second position, with an intermediate space (52) between the release membrane and the second membrane being capable of being subjected to dynamic pressure.

2. Control system according to claim 1, wherein the triggering membrane (36) closes or opens a second chamber (44) as a function of the position of the first valve (32), which is located in the flow path between the source of low pressure and the first chamber (72) in the first connection (46).

3. Control system according to claim 2, wherein the second chamber (44) is adjustable via the housing (12) of the control system (10) by an adjusting element (200) that can be actuated from outside with reference to the triggering membrane (36) in the area subjected to pressure.

4. Control system according to claim 3, wherein the second chamber (44) has a circular area on the side of the triggering membrane, which is restricted by a peripheral sealing element (86) like an O-ring, and the sealing element actuates the adjusting element (200) that is accessible from the exterior of the housing for adjusting the sealing element.

5. Control system according to claim 3, wherein the adjusting element (200) is adjustably arranged in a channel-shaped opening such as housing bore (12), which is sealed tightly from outside.

6. Control system according to claim 2, wherein the triggering membrane (36) has a position sealing the second chamber (44) in the shape of U or double-U-shaped geometry with a circulating edge in the shape of an L, via which the triggering membrane is fixed in a first intermediate wall (28) of the housing (12).

7. Control system according to claim 1, wherein the second membrane (38) with an edge section is aligned to one channel-like section (94) of the second connection (90, 94, 96, 98) running in the housing wall (12) and closes the same in case of an opened first valve.

8. Control system according to claim 1, wherein the second membrane (38) emanates from a disk-shaped first mounting plate (54), which is connected via the spacer element (40) with the triggering membrane (36).

9. Control system according to claim 1, wherein the first membrane (74) proceeds from a second mounting plate (76), a side of the second mounting plate restricting the first chamber (72) is forced toward a second housing intermediate wall (30) by the spring element (75), running within the first chamber, a piston (78), adjacent to the housing intermediate wall, of the second valve (34) originates from the second mounting, which is adjustable with its valve disk (50) in a fourth chamber and can be sealed on to a valve seat (48), and in the fourth chamber, a connection (20) of the low pressure source and a connection (22) run into the purge valve, whereby in case of the first chamber subjected to low pressure and adjusting the second mounting plate vis-à-vis the force of the spring element (75), the valve disk is spaced apart from the valve seat and a connection exists between the connections.

10. Control system according to claim 9, wherein the second mounting plate (76) with the first membrane (74) and the second intermediate wall (30) restricts a third chamber (82), which is subjected to atmospheric pressure via a connection (24), whereby the third chamber is connected via the piston (78) of the second valve (34) with closed second valve with the fourth chamber (64)) and with opened second valve the third chamber is locked opposite the fourth chamber.

11. Control system according to claim 1, wherein the second valve (34) has a valve piston (78), which with a section (160) puts through a plane stressed by the valve disk (50) in such a manner that using the section of the exterior of housing, an axial force can be applied to open the second valve.

12. Control system according to claim 1, wherein in a functional position of the control system (10), the first connection leading to the source of low pressure, the second connection leading to the purge valve as well as the third connection connected with the atmosphere pass over to tubular pipe unions (20, 22, 24), which run vertically or essentially vertically, and are connected with the third and fourth chambers (82, 64) in such a manner that the accumulated liquid flows off due to gravity.

13. Control system for a purge valve that can be actuated by low pressure, intended for a low pressure waste water system, comprising a first valve (32) as well as a second valve (34) functionally connected with the latter, the purge valve being actuatable as a function of its position, with the accumulated waste water able to be drawn off via the sewage system, wherein a dynamic pressure developed by accumulated waste water acts on the first valve (32), which impinges on a gap (52) between a triggering membrane (36) and a dynamic pressure membrane (38), which form a unit and the first valve.

* * * * *